United States Patent [19]

LaBate

[11] Patent Number: 4,632,367

[45] Date of Patent: Dec. 30, 1986

[54] DEVICE FOR INTRODUCING GAS INTO MOLTEN METAL

[76] Inventor: Michael D. LaBate, 115 Hazen Ave., Ellwood City, Pa. 16117

[21] Appl. No.: 769,413

[22] Filed: Aug. 26, 1985

Related U.S. Application Data

[63] Continuation-in-part of Ser. No. 662,831, Oct. 19, 1984, Pat. No. 4,538,795.

[51] Int. Cl.[4] ..... C21C 5/48

[52] U.S. Cl. ..... 266/220; 266/270

[58] Field of Search ..... 266/217, 220, 265, 266, 266/270

[56] References Cited

U.S. PATENT DOCUMENTS

| | | | |
|---|---|---|---|
| 2,811,346 | 10/1957 | Spire | 266/220 |
| 3,208,117 | 9/1965 | Goedecke et al. | 22/214 |
| 3,330,645 | 7/1967 | DeMoustier et al. | 266/220 |
| 3,610,602 | 10/1971 | Deacon | 266/220 |
| 3,834,685 | 9/1973 | Ziemkiewicz et al. | 266/220 |
| 4,053,147 | 1/1976 | Moser et al. | 266/220 |
| 4,396,179 | 8/1983 | LaBate | 266/217 |

FOREIGN PATENT DOCUMENTS 2451945 10/1980 France .

*Primary Examiner*—L. Dewayne Rutledge
*Assistant Examiner*—Robert L. McDowell
*Attorney, Agent, or Firm*—Harpman & Harpman

[57] ABSTRACT

A solid non-permeable refractory plug has a spaced stainless steel and/or ceramic jacket and is located in a pocket block for incorporation in the normal refractory brick lining of a ladle to provide a passageway through which gas can be introduced into the molten metal. The stainless steel and/or ceramic jacket extends above the refractor plug and the pocket block to form a hot metal dam that protects the passageway from metal and/or slag penetration during the filling of the ladle with molten metal.

6 Claims, 3 Drawing Figures

DEVICE FOR INTRODUCING GAS INTO MOLTEN METAL

This is a continuation in part of Ser. No. 06/662,831 filed 10/19/84, now U.S. Pat. No. 4,538,795.

BACKGROUND OF THE INVENTION

1. Technical Field

This invention relates to devices for insufflating gas into a mass of molten metal.

2. Description of the Prior Art

Prior structurs of this type have generally employed permeable plugs through which the gas is introduced into the molten metal. Such typical devices may be seen in U.S. Pat. Nos. 2,811,346, 3,330,645, 3,610,602, 3,834,685 and 4,053,147. In all of these prior art devices, the gas must flow upwardly through a gas permeable body which in U.S. Pat. No. 3,811,346 is a porous refractory material. The same porous material is disclosed in Patent 3,330,645 and this patent additionally proposes to form tubular passageways through the porous material. The body of the device in U.S. Pat. No. 3,610,602 is formed of permeable refractory as is the body of the device shown in U.S. Pat. No. 3,834,685 and the same is true of the body of the device shown in U.S. Pat. No. 4,053,147.

French Pat. No. 2,451,945 has a porous stopper plug as has U.S. Pat. No. 3,208,117.

The present invention comprises an improvement with respect to my U.S. Pat. Nos. 4,396,179 and 4,483,520 wherein a non-permeable refractory plug is disclosed having a spaced stainless steel jacket thereabout forming an annular passageway through which the gas is introduced into the molten metal. A displaceable cap is provided in these devices for initially protecting the upper end of the device and the annular gas passageway from being plugged by molten metal introduced into the ladle in which the device is positioned.

In actual practice, it has been determined that the cap is frequently displaced by the molten metal and the molten metal tends to plug the annular gas passageway unless a substantially higher gas pressure is employed to move the molten metal away from the annular gas emitting opening.

Furthermore, the molten metal first introduced into a ladle equipped with the device tends to freeze almost instantaneously and frequently before the gas is introduced or during the initial introduction of the gas and thus closes the annular gas passageway and renders the device ineffective.

The present invention adds a hot metal dam above the annular gas emitting passageway of the device and protects the passageway and the upper portion of the device from the molten metal whether the gas is flowing or not and when the gas flows, it improves the stirring action sustantially by forming a large and distinct and jet-like stream of the gas bubbles which result in increased turbulence and stirring action in the molten metal.

SUMMARY OF THE INVENTION

A device for introducing gas into molten metal upon the filling of a ladle or the like with such molten metal uses a pocket block of refractory which is incorporated in the bricked or rammed lining of the ladle, the block having a vertically extending passageway therethrough and a plug positioned therein comprising a non-permeable refractory plug with a spaced stainless steel and/or ceramic shell thereabout to define a gas passageway through the block. A combined shield and hot metal dam in the form of an upwardly extending circular extension of the stainless steel and/or ceramic shell is positioned above the opening defined thereby and protects the non-permeable refractory plug whereby gas for agitating, stirring rolling and/or affecting the desired chemistry of the molten metal can be introduced into the molten metal in suitable streams substantially increasing the agitating, stirring, and rolling action obtained.

DESCRIPTION OF THE PREFERRED EMBODIMENT

Figure 1:
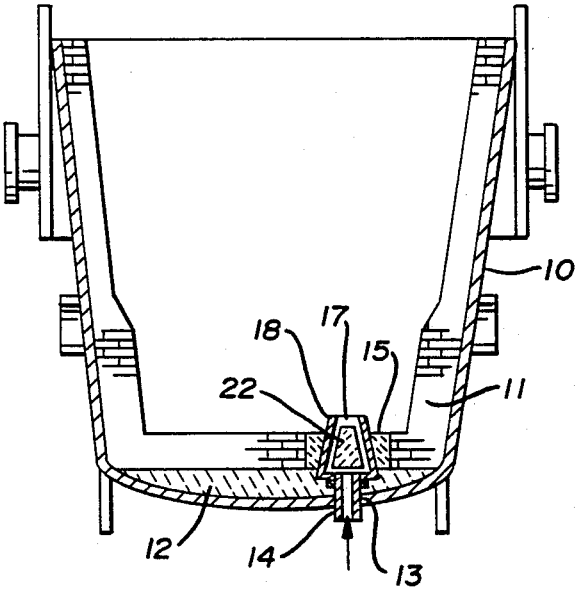
FIG. 1 is a sectional side elevation of a ladle showing the device for introducing gas into molten metal installed therein.
Figure 2:
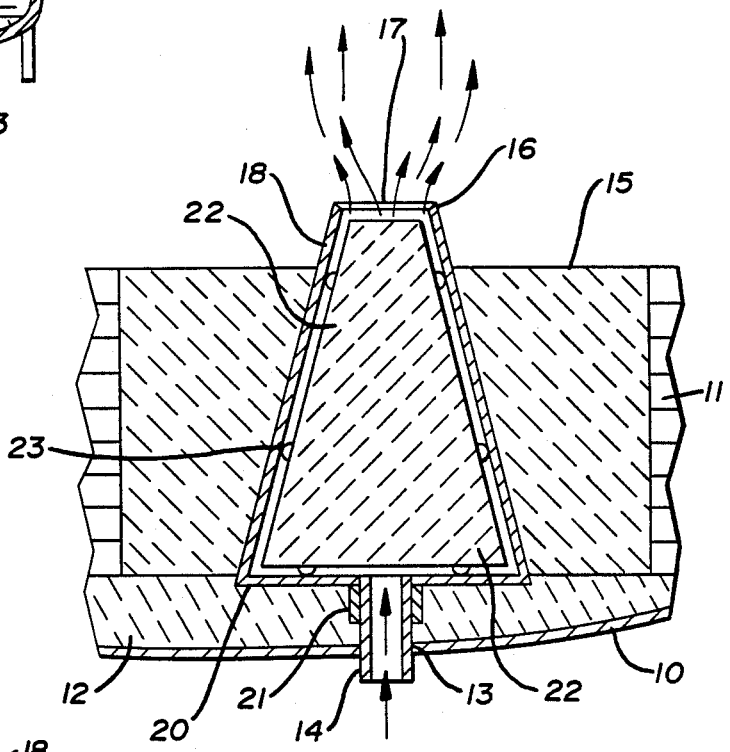
FIG. 2 is an enlarged cross sectional detail of the device or introducing gas into molten metal and illustrating the hot metal dam with arrows indicating the stream of gas occasioned by its presence.
Figure 3:
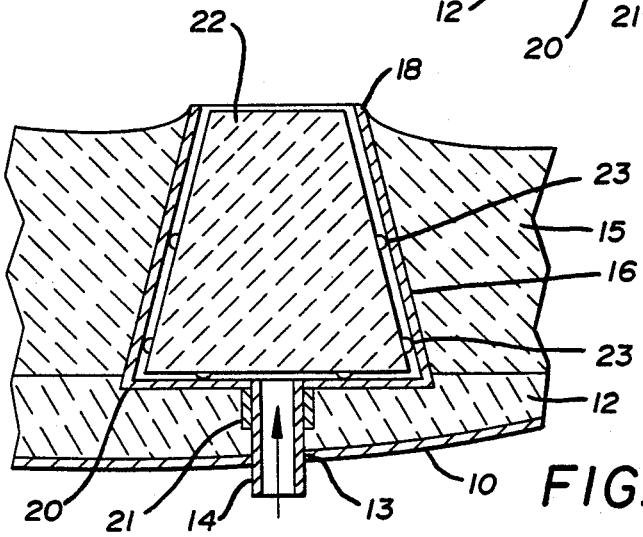
FIG. 3 is an enlarged cross sectional detail with parts broken away and parts in cross section of the device of the invention in an eroded pocket block.

In the form of the invention chosen for illustration herein, the device for introducing gas into molten metal in an improved manner may be seen in FIGS. 1, 2 and 3 of the drawings in a ladle 10 having a refractory brick lining 11 incorporating a rammed refractory base 12. An opening 13 in the bottom of the ladle 10 is provided with a tube 14 through which gas is introduced. A pocket block 15 is provided with a conical passageway centrally thereof which is arranged in registry with the inner upper end of the tube 14. A frustoconical shell 16, preferably made of stainless steel or a fired ceramic or a ceramic coated metal as best seen in FIG. 2 of the drawings, has an open upper end 17 extending substantially above the pocket block 15 so as to form a protective hot metal dam 18 with respect to the open end 17 of the frusto-conical shell 16.

By referring to FIG. 2 of the drawings, it will be seen that the bottom of the frusto-conical shell 16 comprises a circular disc 20 having an annular depending flange 21 centrally thereof about an opening therethrough, the flange 21 being adapted for registry over the tube 14 through which the gas is introduced into the ladle as illustrated by the arrows.

The majority of the interior of the frusto-conical shell 16 is filled by a non-permeable ceramic plug 22 which is substantially the same height as the shell 16 and the configuration 23 on the exterior of the plug 22 or alternately on the interior of the shell 16 provide for the spacing of the shell 16 with respect to the plug 22 so that a gas passageway annular in cross section is formed through the pocket block 15 and thus provides that the gas introduced into the tube 14 will flow around the exterior of the plug 22 and outwardly through the opening 17 and be effectively directed by the hot metal dam 18 as shown by the arrows in FIG. 2 of the drawings. The vertical dimension of a typical pocket block (15) is at least 12 inches and the shell 16 and plug 22 are of substantially greater height than said pocket block.

By referring to FIG. 2 of the drawings in particular, it will be observed that the arrows indicating the gas flow paths as occasioned by the hot metal dam forming the upper end of the frusto-conical shell 16 has the highly desired effect of substantialy increasing the agitating, stirring and rolling action of the molten metal through which the gas streams move.

In FIG. 1 of the drawings, the device is shown in operable arrangement in the ladle 10 and it will be observed that it is of a size and so located in the ladle that the stream of gas emerging from the device by reason of the hot metal dam 18 will occupy a substantially higher overall area in the ladle 10 than has heretofore been possible with the prior art devices.

In operation, the device is installed in the conical passageway in the pocket block 15 immediately prior to the installation of the pocket block 15 in the lining of the ladle 10. Such installation is facilitated by the presence of the hot metal dam 18 as the same forms a convenient handle in holding and adjusting the device in the conical passageway of the pocket block 15 and insuring the positioning of the device and more particularly the frusto-conical shell 16 thereof in engaging relation in the conical passageway as the pocket block 15 is positioned in the lining of the ladle for registry with the opening in the refractory base 12 through which the tube 14 extends.

In FIG. 3 of the drawings, the upper end of the shell 16 and the plug 22 are illustrated as extending upwardly above the eroded sides of the pocket 15 so that the shell 16 continues to protect the plug 22 and the adjacent portions of the pocket block 15 from rapid erosion.

The arrangement is such that the hot metal dam 18 is protected by the cooling effect of the gas being introduced through the device and directed thereagainst by the formation of the end 17 with the result that metal initially poured into the ladle 10 and striking the hot metal dam 18 does not adversely affect the shell 16 which remains in position through the initial pouring stages and thereafter when the molten metal has covered the same, all due to the effective cooling, stirring, agitating and rolling action of the molten metal as occasioned by the jet stream of the gas being introducted thereinto.

It will occur to those skilled in the art that the device disclosed herein protects the frusto-conical shell thereof as well as preventing the plugging of the annular gas passageway defined between the shell 16 and the plug 22 as would otherwise occur upon the introduction of molten metal into the ladle. The solid ceramic plug 22 cannot be filled with metal as occurs in the prior art devices wherein the plugs are formed of porous refractory material and the device thereby insures the desirable immediate introduction of gas into the molten metal which has heretofore been seriously delayed by the blocking of the prior art devices with the molten metal and the unprotected defusing plugs and the like.

The vertical dimension of the pocket block 15 adjacent the conical passageway is substantially smaller than the height of the solid ceramic plug 22, and the height of the shell 16 with the hot metal dam 18 is greater than the height of the pocket block 15 so as to form the hot metal dam around the annular gas passageway.

Although but one embodiment of the present invention has been illustrated and described, it will be apparent to those skilled in the art that various changes and modifications may be made therein without departing from the spirit of the invention and having thus described my invention.

What I claim is:

1. In a device for introducing gas into a mass of molten metal in a container, the improvement which comprises a refractory plug and an open ended shell positioned thereabout in spaced relation thereto and defining an opening around said refractory plug, a pocket block having a passageway extending vertically therethrough, said pocket block adapted to form a portion of a refractory lining in said container for said molten metal, said container having an opening therein in registry with said passageway in said pocket block, said refractory plug and said shell positioned in said passageway in said pocket block with said shell and refractory plug extending outwardly of and above said passageway in said pocket block in protecting relation to said refractory plug with respect to molten metal introduced into said container and so as to form a hot metal dam protecting said opening around said refractory plug.

2. The improvement in a device for introducing gas into a mass of molten metal set forth in claim 1 and wherein said shell comprises a frusto-conical shape, the ends of the shell being open.

3. The improvement in a device for introducing gas into a mass of molten metal set forth in claim 1 and wherein the overall height of said refractory plug is greater than the height of said vertical passageway in said pocket block and wherein said shell extends upwardly and outwardly of said passageway in said pocket block and is of an overall height greater than the height of said refractory plug.

4. In a device for introducing gas into a mass of molten metal, the improvement which comprises a plug of non-premeable refractory material and a shell positioned thereabout in spaced relation thereto and defining an opening around said non-premeable plug, a pocket block having an opening extending vertically therethrough, said pocket block adapted to form a portion of refractory lining in a container for said molten metal, said container having an aperture therein in registry with said opening in said pocket block, said non-premeable plug and said shell positioned in said opening in said pocket block and facing the interior of said container so as to form a gas passageway through said pocket block and form a circular hot metal dam around said opening and said non-premeable plug with respect to said pocket block and molten metal thereon.

5. The improvement in a device for introducing gas into a mass of molten metal set forth in claim 4 and wherein said opening in said pocket block is frustroconical, said non-premeable plug is frusto-conical and said shell is frusto-conical and are of diameters enabling said shell to be positioned in said opening, and said non-premeable plug to be positioned in said shell in said spaced relation thereto.

6. The improvement in a device for introducing gas into a mass of molten metal set forth in claim 4 and wherein said pocket block is of a known thickness dimension, the opening therethrough is of the same dimension as said known thickness dimension of said pocket block and the shell and the non-premeable plug are of a greater dimension that said known thickness dimension of said pocket block so as to extend outwardly and above said pocket block and so as to form a hot metal dam around said non-premeable plug and said gas passageway.

* * * * *